United States Patent [19]

Bierman et al.

[11] 4,157,165

[45] Jun. 5, 1979

[54] COIL WINDING AND TERMINATING MACHINE

[75] Inventors: Richard L. Bierman, Pelham, N.H.; Hazen Curtis, III, Andover, Mass.

[73] Assignee: Bell Telephone Laboratories, Incorporated, Murray Hill, N.J.

[21] Appl. No.: 858,388

[22] Filed: Dec. 7, 1977

Related U.S. Application Data

[63] Continuation of Ser. No. 686,460, May 14, 1976, abandoned.

[51] Int. Cl.[2] ..... H01F 41/06; H01F 41/10

[52] U.S. Cl. ..... 242/7.09; 242/7.14; 242/7.17

[58] Field of Search ..... 242/7.18, 7.17, 7.06, 242/7.21, 7.03, 2, 3, 7.09; 140/92.1

[56] References Cited

U.S. PATENT DOCUMENTS

| | | | |
|---|---|---|---|
| 2,966,935 | 1/1961 | Wiltshire | 242/2 X |
| 3,333,778 | 8/1967 | Levenetz et al. | 242/3 |
| 3,713,599 | 1/1973 | Smith et al. | 242/7.18 |
| 3,963,185 | 6/1976 | Quirk | 242/7.21 |

FOREIGN PATENT DOCUMENTS

| | | | |
|---|---|---|---|
| 260389 | 3/1968 | Austria | 242/7.02 |

*Primary Examiner*—Billy S. Taylor
*Attorney, Agent, or Firm*—Peter V. D. Wilde

[57] ABSTRACT

Apparatus for winding a coil by feeding wire from a wire guide to a rotating bobbin and for terminating the coil by orbiting the wire guide about terminals projecting from the bobbin is made more versatile by mounting the wire guide so that it can be rotated from a position in which it feeds wire in a direction perpendicular to the bobbin axis to a position in which it feeds wire in a direction parallel to the bobbin axis. This construction permits termination of the coils upon terminals projecting from the bobbin in a direction parallel to the bobbin axis as well as those perpendicular to the bobbin axis. Introducing an offset portion to the spindle upon which the bobbin is rotated permits the wire guide to be brought into a position in which it can wrap a terminal projecting parallel to the coil axis on the inner or spindle side of the bobbin.

4 Claims, 3 Drawing Figures

COIL WINDING AND TERMINATING MACHINE

This application is a continuation of application Ser. No. 686,460, filed May 14, 1976 and now abandoned.

This invention relates to apparatus for winding wire into a coil upon a bobbin and terminating the coil by wrapping the ends of the wire about terminals projecting from the bobbin.

BACKGROUND OF THE INVENTION

U.S. Pat. No. 3,713,599 (Canadian Pat. No. 935,417) describes in detail a coil winding machine provided with spindles upon which bobbins are mounted to which wire is fed, in a direction perpendicular to the axis of the spindle, by wire guides which are laterally movable in a plane parallel to the axis of rotation of the spindles and bobbins. With such prior art apparatus the wire can be wrapped around a terminal projecting from the bobbin in a direction perpendicular to the bobbin axis by moving the wire guide to a position adjacent the terminal and then orbiting the wire guide about the terminal. The wire can be wound into a coil upon the bobbin by moving the wire guide along the appropriate portion of the bobbin while the spindle and bobbin are rotated.

SUMMARY OF THE INVENTION

The present invention is similarly a machine in which coils are wound, by a laterally moving wire guide, upon bobbins mounted upon spindles rotating about the bobbin axis but this machine is more versatile in permitting termination of the coil not only upon terminals extending from the bobbin in a direction perpendicular to the bobbin axis, but also upon terminals extending in other directions such as parallel to the bobbin axis.

This is accomplished by so constructing the wire guide and the spindle that the angle between the spindle axis and the direction in which wire is fed by the wire guide is variable between perpendicular and parallel. This angular relationship is most advantageously accomplished by providing a wire guide which is rotatable about an axis perpendicular to the spindle axis.

When the wire guide is rotated into a position in which it feeds wire in a direction perpendicular to the spindle axis, it can be laterally positioned adjacent a terminal perpendicular to the bobbin axis and then orbited about the terminal while the bobbin is stationary to wrap the wire about the terminal. The wire guide in the same angular position can be moved laterally along the bobbin while the bobbin is rotated on the spindle to wind a coil on the bobbin.

When the wire guide is rotated into a position in which it feeds wire in a direction parallel to the spindle axis, it can be positioned adjacent a terminal parallel to the bobbin axis and orbited about the terminal to wrap the wire about this terminal. If, for any reason, it is desired to wrap the wire about a terminal mounted on the bobbin at an angle between the perpendicular and the parallel to the bobbin axis, the wire guide and the bobbin can be rotated into a position in which wire is fed parallel to the terminal and the guide can then be orbited about the terminal.

In order to permit termination by wrapping upon terminals mounted parallel to the bobbin axis and on the spindle side of the bobbin, a length of the spindle adjacent to the bobbin can be constructed so that it is offset to provide a recess into which the wire guide can be rotated when the spindle is at rest.

DETAILED DESCRIPTION

Figure 1:
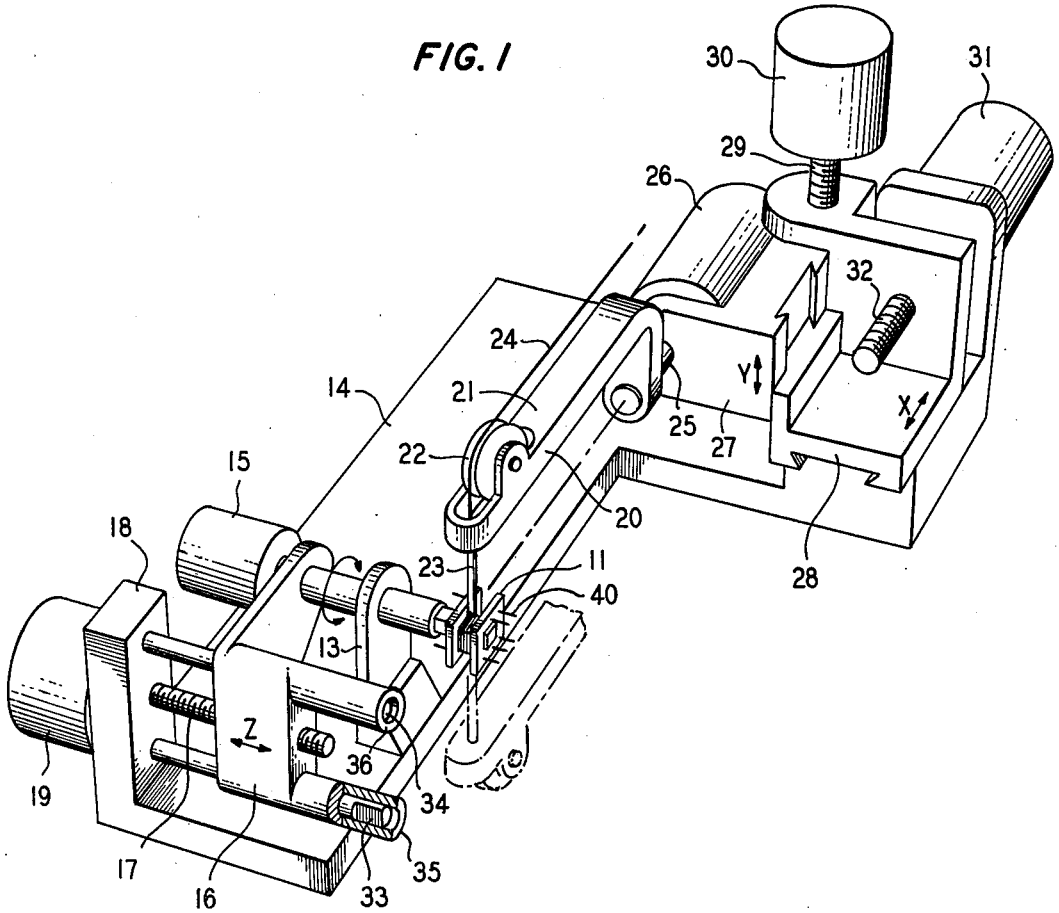
FIG. 1 is a perspective view of the machine of the present invention with a bobbin mounted on the spindle and with the wire guide in coil winding position, the wire guide being also shown in phantom rotated to an opposite coil winding position.
Figure 2:
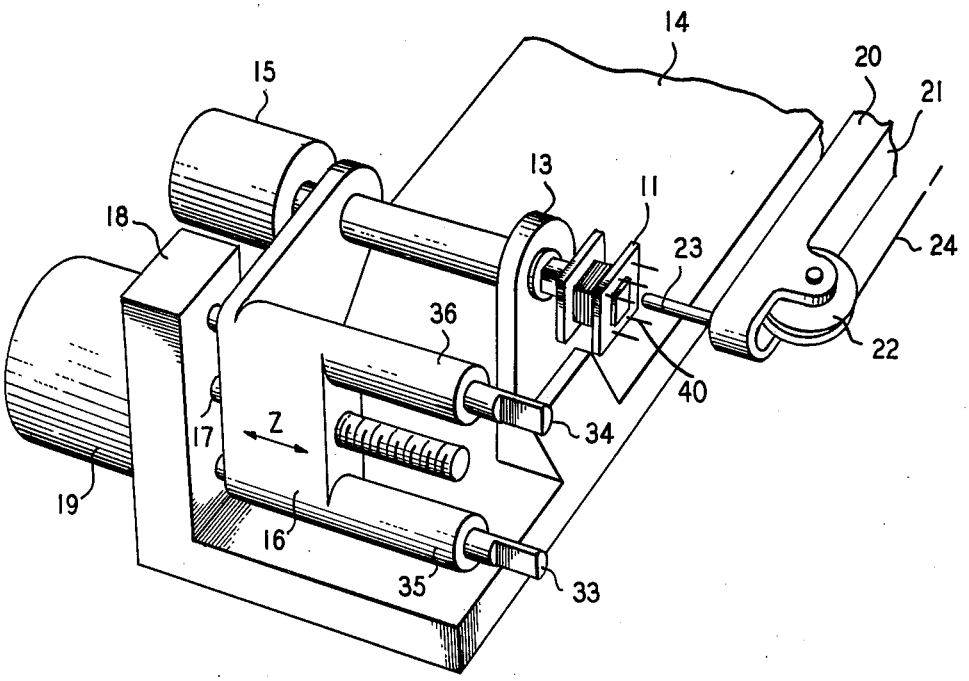
FIG. 2 is a perspective view of the machine of FIG. 1 with the wire guide assembly rotated 90° and in a position for wrapping a terminal parallel to the bobbin axis.

In FIGS. 1 and 2 bobbin 11 is shown mounted upon spindle 12 which is supported in a journal in projecting member 13 of base 14 in which it is both rotatably and axially movable. Spindle 12 is rotatable in either direction by motor means 15 which is supported in and affixed to block 16, which is movable in the Z direction (or along the spindle axis) by the rotation of threaded shaft 17 in a threaded bore of block 16. Shaft 17 is rotated, in a journal in support 18 projecting upwardly from base 14, by motor means 19 affixed to support 18.

Wire guide assembly 20 consisting of arm 21, pulley 22 and guide 23 feeds wire 24 from source, not shown, to the bobbin. The wire guide assembly is mounted on a shaft 25 which is rotatable by motor means 26. The shaft 25 is journaled in block 27 which is slidably supported upon block 28 and is movable in the Y (or vertical) direction by rotation of threaded shaft 29 in a threaded bore of block 27. Rotation of shaft 29 is accomplished by motor means 30 affixed to block 28. Block 28 is mounted upon base 14 so that it is slidable in the X direction (or horizontally perpendicular to the spindle axis). This motion of block 28 occurs when motor means 31 affixed to base 14 turns threaded shaft 32 in a threaded bore of block 28.

Anchor pins 33,34 are fixedly mounted on support 18 and extend through sleeves 35,36 on movable block 16.

Figure 3:
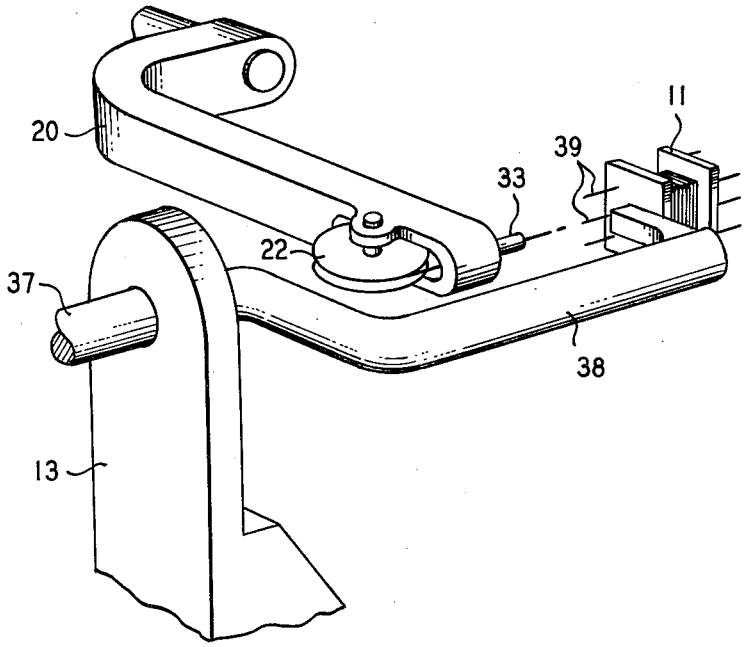
FIG. 3 is perspective view of an alternative spindle structure with the wire guide in position for permitting termination upon terminals on the spindle side of the bobbin.

The modification shown in FIG. 3 differs from the corresponding elements shown in FIG. 1 only in that the spindle 37 upon which the bobbin 11 is mounted contains a recess created by an offset portion 38 into which the wire guide assembly 20 is shown rotated so that it can be moved into a position in which wire guide 23 is adjacent to terminals 39 on the spindle side of the bobbin. In this position orbiting of the wire guide about the terminal will create a wrapped termination.

OPERATION

The coil winding and terminating operations of the machine of the present invention will follow, in general, the procedures described in U.S. Pat. No. 3,713,599 (Canadian Pat. No. 935,417)except for the added versatility of the present machine.

Initially, block 16 is in a retracted position in which anchor pins 33,34 project beyond sleeves 35,36. Wire guide assembly 20 is rotated to an angular position corresponding to that shown in FIG. 2 and blocks 27,28 are moved laterally until wire guide 23 is alongside the anchor pin most appropriate for the subsequent operation. Blocks 27,28 are then moved so as to create an orbiting motion of wire guide 23 about the anchor pin. In the start-up operation the wire 24 will have to be held separately taut as it emerges from the wire guide so as to establish a wrapping and anchoring of the wire. Once the operation has been established the wire will thereafter be left wrapped around an anchor pin at the completion of the final terminating operation on the bobbin so that the anchoring operation need not be repeated prior to operation upon the next succeeding bobbin.

After the anchoring operation, the wire guide assembly is moved into a position in which the wire guide is adjacent one of the terminals 40 on the bobbin. If the terminals are parallel to the bobbin axis as shown in FIG. 1 and on the outer side of the bobbin, the wire guide assembly can be translated into position without rotation or, in the modification shown in FIG. 3, can be rotated into the position shown in that figure. If the terminals are perpendicular to the bobbin axis, the wire guide assembly can be rotated into the angular position shown in FIG. 1 or into the phantom position and then translated so that the wire guide 23 is adjacent the terminal. Orbital motion of the wire guide assembly will then cause wrapping of the wire about the terminal.

The wire guide assembly is then translated and rotated, if necessary, into coil winding position as shown in FIG. 1. The shaft 12 with the bobbin mounted on it is then rotated while block 16 is moved laterally so as to create a winding of the desired pitch upon the bobbin. The rotation of the bobbin breaks the wire extending between the anchor pins and the bobbin terminal leaving the residual wire wrapping on the anchor pin. The motion of the block 16 during the winding operation advances the sleeves 35,36 over the anchor pins 33,34 and pushes the residual wire wrapping off the anchor pin.

After the coil winding operation is completed, the wire guide assembly is again translated and rotated, if necessary, until the wire guide 23 is again adjacent an appropriate terminal. Termination of the wire on this terminal is again accomplished by orbiting the wire guide assembly.

The wire guide assembly is then moved into position for wrapping around an anchor pin and such wrapping is caused to take place. A partial rotation of the shaft 12 and the bobbin will then cause the wire extending between the terminal and the anchor pin to break and the completed coil can be removed. The wire is now already wrapped around an anchor pin for the beginning of the next operation upon a new bobbin.

What is claimed is:

1. An apparatus for winding and terminating an electrical coil by winding wire into a coil on a bobbin having projecting terminals and by wrapping the wire ends of the coil about the terminals, said apparatus comprising:

a. a rotatable spindle adapted to support a bobbin mounted on the end thereof with its axis essentially coincident with the axis of rotation of the spindle, said bobbin supporting electrical terminals projecting therefrom;

b. a wire guide for feeding wire to said bobbin and terminals; means for extending said wire guide away from its support means so as to have a free end; a wire delivery opening adjacent said free end through which the wire is fed to the bobbin or terminals; a rotatable member by means of which the wire guide can be rotated about an axis essentially perpendicular to the axis of the spindle; motor means for rotating said rotatable member so that the wire can be fed perpendicular to the spindle axis during the winding of the bobbin and can be fed perpendicular or parallel to the spindle axis during the wrapping of the wire about the terminals; and c. supporting carriage means by which the wire guide and spindle can be moved in three mutually perpendicular directions with respect to one another and motor means for moving said carriage means so that the wire guide and a terminal can be moved into juxtaposition and an orbiting motion imparted to the wire guide so as to wrap the terminal with wire.

2. In apparatus as described in claim 1, the further improvement wherein the spindle is constructed with an offset portion permitting the wire guide to assume a position parallel to the bobbin axis on the spindle side of the bobbin when wrapping wire about said terminal.

3. An apparatus for winding and terminating an electrical coil by winding wire into a coil on a bobbin having projecting terminals and by wrapping the wire ends of the coil about the terminals, said apparatus comprising:

a. a rotatable spindle adapted to support a bobbin mounted on the end thereof with its axis essentially coincident with the axis of rotation of the spindle, said bobbin supporting electrical terminals projecting therefrom;

b. means of moving said spindle linearly along the axis of rotation, comprising support block and motor means for moving said support block so as to position the spindle so that either the coil winding portion of the bobbin or the terminals on the bobbin are adjacent to the wire guide;

c. a wire guide for feeding wire to said bobbin and terminals; means for extending said wire guide away from its support means so as to have a free end; a wire delivery opening adjacent said free end through which the wire is fed to the bobbin or terminals; a rotatable member by means of which the wire guide can be rotated about an axis essentially perpendicular to the axis of the spindle; motor means for rotating said rotatable member so that the wire can be fed perpendicular to the spindle axis during the winding of the bobbin, and can be fed perpendicular or parallel to the spindle axis during the wrapping of the wire about the terminals; and d. a means of moving said wire guide comprising a carriage support movable in two mutually perpendicular directions which are each mutually perpendicular to the axis of rotation of the spindle, and motor means for moving said carriage support so that the wire guide can be moved into juxtaposition with a terminal and an orbiting motion imparted to the wire guide so as to wrap the terminal with wire.

4. In apparatus as described in claim 3, the further improvement wherein the spindle is constructed with an offset portion pemitting the wire guide to assume a position in juxtaposition with a terminal parallel to the bobbin axis on the spindle side of the bobbin so that the wire can be wrapped about said terminal by orbiting of the wire guide.

* * * * *